United States Patent [19]

Sueyoshi et al.

[11] Patent Number: 4,969,841

[45] Date of Patent: Nov. 13, 1990

[54] DOUBLE LOCKING STRUCTURE FOR TERMINAL IN ELECTRICAL CONNECTORS

[75] Inventors: Tadahiro Sueyoshi; Masanori Tsuji; Takayuki Yamamoto; Masaru Fukuda, all of Shizuoka, Japan

[73] Assignees: Yazaki Corporation, Toyota; Toyota Jidosha Kabushiki Kaisha, Aichi, both of Japan

[21] Appl. No.: 494,373

[22] Filed: Mar. 16, 1990

[30] Foreign Application Priority Data

Mar. 29, 1989 [JP] Japan ..... 1-34809

[51] Int. Cl.[5] ..... H01R 13/44

[52] U.S. Cl. ..... 439/595; 439/594; 439/603

[58] Field of Search ..... 439/594, 595, 603

[56] References Cited

U.S. PATENT DOCUMENTS 3,886,619 8/1972 McCardell, Jr. et al. ..... 439/595
3,982,805 9/1976 Irie ..... 439/595
4,711,508 12/1987 Sueyoshi ..... 439/603
4,806,123 2/1989 Konishi et al. ..... 439/595

FOREIGN PATENT DOCUMENTS 2376582 9/1978 France ..... 439/595
59-148080 10/1984 Japan .
61-161974 10/1986 Japan .

*Primary Examiner*—Paula A. Bradley

[57] ABSTRACT

An electrical connector for preventing the terminal from slipping off from the rear thereof. The connector comprises a connector housing having a terminal accommodating chamber therein, a flexible engagement arm provided to the inner wall of the terminal accommodating chamber of the connector housing, the flexible arm extending forwardly, and engagement portion formed in a terminal for engagement with the tip of the flexible engagement arm, engagement pieces at each side of the engagement portion of the terminal, and engagement projection formed at each side of the flexible engagement arm, the engagement projections each having a vertical shoulder surface at the front and a tapered slope at the back thereof. The shoulder surfaces of the engagement projections are engaged with the rear edges of the engagement pieces of the terminal while at the same time the flexible engagement arm tip is engaged with the engagement portion of the terminal to provide a double locking for preventing the terminal from slipping off from the rear of the connector housing.

5 Claims, 3 Drawing Sheets

A
B
C
1
2
3
4
5
6
6a
7
8
8a
8b
8c
9
10
11
12
13
14
15
16
17
18
B1
B2
t

DOUBLE LOCKING STRUCTURE FOR TERMINAL IN ELECTRICAL CONNECTORS

BACKGROUND OF THE INVENTION

1. Field of the Invention

The present invention relates to a double locking structure for terminal in electrical connectors which is simple in construction and provides a large locking force without increasing a resistance against the terminal being inserted into a terminal accommodating chamber of a connector housing, thereby reliably preventing the terminal from slipping off from the rear of the connector.

2. Description of the Prior Art

A common method of fixing the terminal in the electrical connector and preventing it from slipping off from the back of the connector is by integrally forming a forwardly extending flexible engagement arm on the inner wall of the terminal accommodating chamber, so that the flexible engagement arm is engaged with the terminal inserted into the terminal accommodating chamber.

However, a single-step flexible engagement arm can provide only a weak locking force, so the terminal may come off. To prevent this, some proposals have been made. For example, the Japanese patent Publication No. Showa 54-24116 proposes a structure in which flexible engagement arms are provided to both side walls of the terminal accommodating chamber so as to hold the terminal from both sides. The Japanese Utility Publication No. Showa 54-44779 discloses a structure in which a leaf-spring-shaped housing lance (flexible engagement arm) formed in the connector housing and a leaf-spring-shaped terminal lance formed on the terminal provide a double locking for the terminal. In these cases, while the housing or terminal lances increase the terminal fixing force, there are drawbacks, such as a large insertion force required to insert the terminal, an increase in the size of the terminal accommodating chamber, and a complex internal structure of the chamber.

Structures intended to provide a double terminal locking without increasing the terminal insertion resistance have been proposed. In the Japanese Utility Model Publication No. Showa 54-28625, for example, a through-hole is provided to the connector housing and a pin is inserted through the hole and engaged with a stepped shoulder portion of the electrical contact of the terminal. The Japanese Utility Model Publication No. Showa 60-31171 discloses a structure in which a terminal retainer portion having projected strips for pressing the terminal and also a locking means is mounted, through a hinge, to the rear part of the housing (on the wire connection side) so that the terminal retainer portion can be opened and closed. These constructions, however, increase the number of parts used in the electrical connector as well as the assembly processes and cost, which in turn increases the size of the housing and complicates the internal structure.

As a means of increasing the terminal fixing force without affecting the terminal insertion resistance and the internal structure, the Japanese Utility Model Preliminary Publication No. Showa 61-7875 discloses a structure in which a lock member is inserted between the flexible engagement arm and the inner wall of the terminal accommodating chamber, to prevent deflection of the flexible engagement arm toward the inner wall thereby providing a secure locking of the terminal.

Even with the lock member inserted between the flexible engagement arm—which engages with the terminal—and the inner wall, the terminal is held by only one engagement projection formed on the flexible engagement arm. This engagement projection is limited in size by the dimensional relationship to the terminal and may be cracked or damaged by a large tension on the connected wire, resulting in the terminal slipping off. Such a connector therefore cannot provide a sufficiently large terminal fixing force.

This invention has been accomplished to eliminate such drawbacks and offer a terminal double-locking structure in electrical connectors which has a simple inner structure of the terminal accommodating chamber, which allows the terminal to be inserted with a small insertion force, and which provides a double locking and large fixing force for the terminal, ensuring a stable electrical connection.

SUMMARY OF THE INVENTION

To achieve the above objectives, this invention provides a double locking structure for terminal in electrical connectors, which comprises: a connector housing having a terminal accommodating chamber therein; a flexible engagement arm provided to the inner wall of the terminal accommodating chamber of the connector housing, the flexible arm extending forwardly; a first engagement projection formed at the free end of the flexible engagement arm, the first engagement projection being adapted to engage with an engagement hole or recess formed in the terminal inserted in the terminal accommodating chamber; a second engagement projection formed at least at one side of the flexible engagement arm; and an engagement piece formed in the terminal, the engagement piece being adapted to engage with the second engagement projection; whereby the first and second engagement projections cooperate to doubly prevent the terminal from slipping off from the rear of the connector.

To avoid an increase in resistance against the terminal being inserted into the terminal accommodating chamber, the second engagement projection is provided between the first engagement projection and a fulcrum of the flexible engagement arm, the apex of the second engagement projection is set lower than the upper surface of the flexible engagement arm, and the rear part of the second engagement projection is preferably formed into a tapered slope.

To increase the fixing or locking force on the terminal, it is desired that a lock member be inserted to prevent the flexible engagement arm from deflecting.

With this invention, the terminal is doubly locked by the first and second engagement projections of the flexible engagement arm to reliably prevent the terminal from slipping off from the back of the connector.

The second engagement projection need only be provided at one or both sides of the flexible engagement arm, so that the internal structure of the terminal accommodating chamber will not be modified significantly, requiring only a partial change in the design of an insert of the die. The same also applies to the engagement piece on the terminal.

It is easy to provide a construction where the second engagement projection is kept out of contact with the engagement piece until the first engagement projection engages with the terminal when the terminal is inserted into the terminal accommodating chamber. In this structure, the terminal can be inserted with the same inserting force as required in the conventional connectors.

When the lock member, which prevents deflection of the flexible engagement arm, is used in combination with the above engagement mechanism, the fixing force on the terminal will further increase.

The construction and features of this invention will be described in detail by referring to the attached drawings showing one embodiment of the invention.

DESCRIPTION OF THE PREFERRED EMBODIMENT

Figures 1, 2, 4:
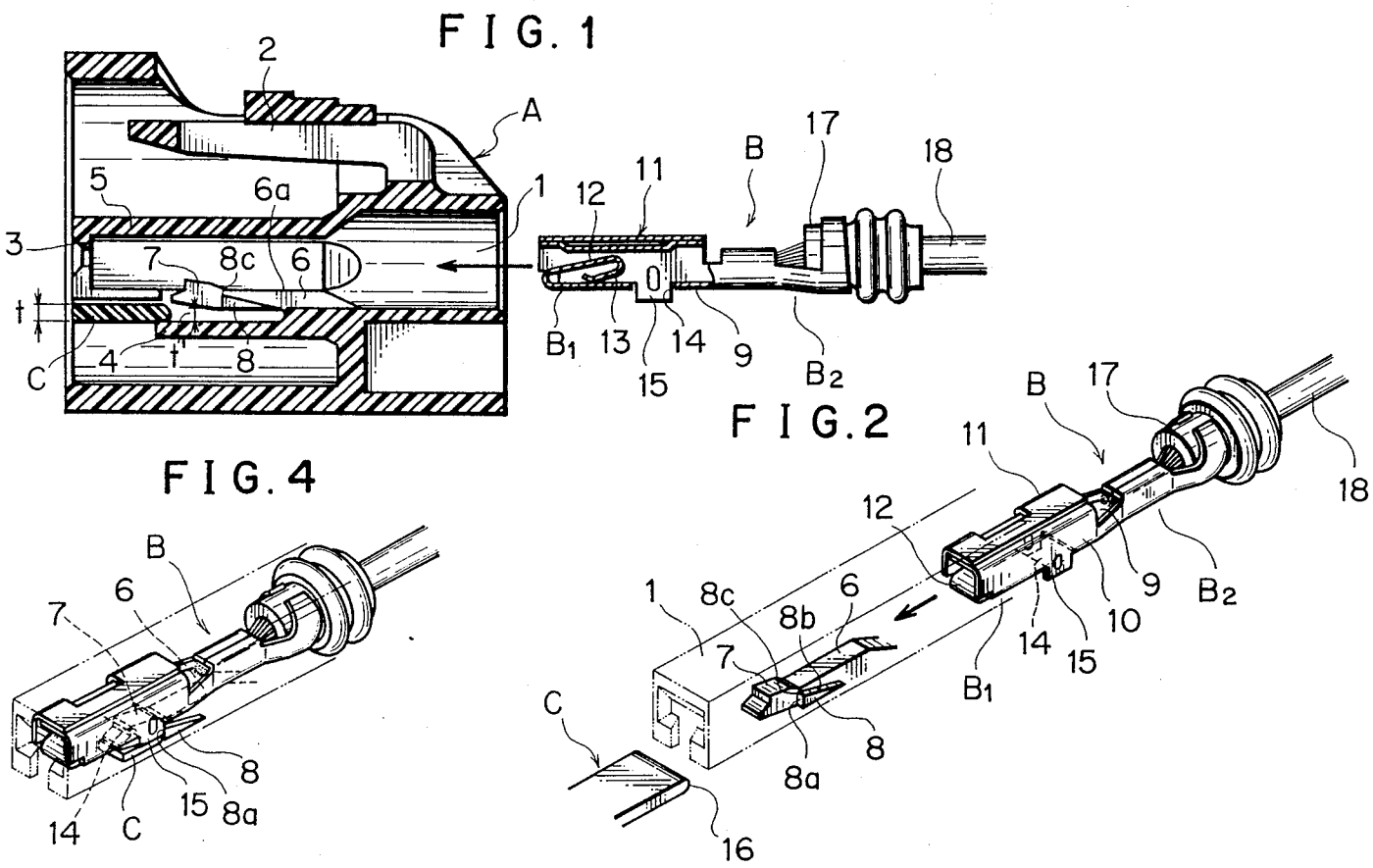
FIG. 1 is a cross section of the connector according to the invention with the terminal separated.
FIG. 2 is a perspective view of essential portions of FIG. 1.
FIG. 4 is a perspective view of essential portions of FIG. 3 with the terminal connected.

Referring to FIGS. 1 and 2, reference symbol A represents a synthetic resin male connector housing, B a terminal, and C a synthetic resin lock member. The male connector housing A is adapted to be engaged with a mating female connector housing not shown.

In the connector housing A there is a terminal accommodating chamber 1 that opens at the front and at the back. On the outside, the connector housing A has a locking arm 2 to lock the female connector housing.

The terminal accommodating chamber 1 has a stopper wall 3 at the front opening and has upper and lower opposing inner walls 4, 5. One of the inner walls 4 is formed integral with a flexible engagement arm 6 that resiliently deflects between the wall 4 and the other opposing wall 5.

The flexible engagement arm 6 has a first engagement projection 7 at the top of its end and second engagement projections 8 integrally formed on each side at the back of the first projection 7. The second engagement projections 8 are shaped into a triangle having a vertical shoulder surface 8*a* at the front side and a moderately tapered slope 8*b* at the rear side. The apex 8*c* of the second projection 8 is set slightly lower than the upper surface 6*a* of the flexible engagement arm 6.

The terminal B consists of a base plate 9, an electric contact portion $B_1$ formed at the front of the base plate 9, and an electric connector portion $B_2$ at the back, these three parts being integrally formed as one piece. The electric connector portion $B_2$ is connected with a wire 18 through a water-proof rubber plug 17.

The electric contact portion $B_1$ consists of: a cylindrical tab receiving portion 11 formed by bending the upper portion of erect side walls 10 on each side of the base plate 9; and a resilient tongue 12 formed by folding the front end of the base plate 9 back into the tab receiving portion 11. The free end of the resilient tongue 12 is further folded toward the base plate 9 to form a resilient support piece 13.

At the electric contact portion $B_1$, the base plate 9 is formed with an engagement hole 14 to accept the flexible engagement arm 6. On each side of the hole 14, there are engagement pieces 15 projecting downwardly. The engagement pieces 15 may be the erected pieces of the base plate 9 that are produced when making the engagement hole 14.

The lock member C is a plate member which has an insertion guide tapered surface 16 at the front end. The thickness of the lock member, t, is set slightly larger than t', a gap between the flexible engagement arm 6 and the inner wall 4.

Next, the double locking of the terminal will be explained by referring to FIGS. 3A to 3D.

Figure 3A:
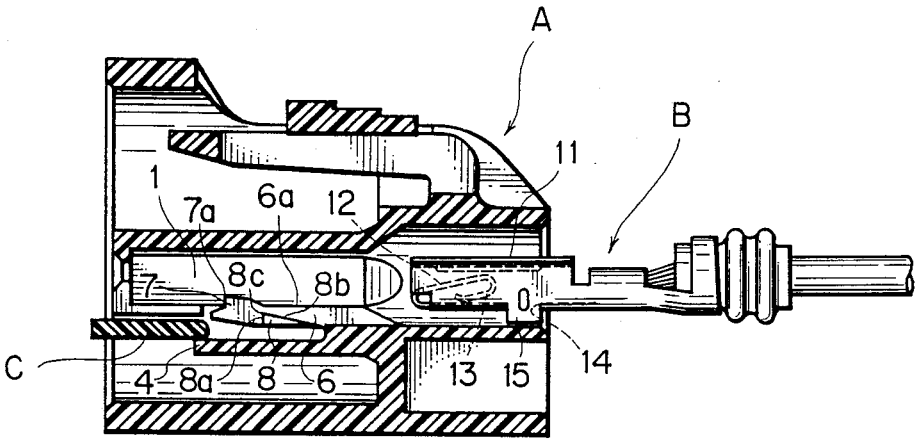
FIGS. 3A to 3D are cross sections showing how the terminal is locked.

As shown in FIG. 3A, the lock member C inserted into the terminal accommodating chamber 1 from the front opening is temporarily locked at a position slightly away from the front end of the flexible engagement arm 6. As the terminal B is inserted, as shown in FIG. 3B, the base plate 9 advances inwardly sliding on the upper surface 6*a* of the flexible engagement arm 6 and reaches the upper slant surface of the first engagement projection 7, pressing the projection to deflect the flexible engagement arm 6 toward the inner wall 4.

Figure 3B:
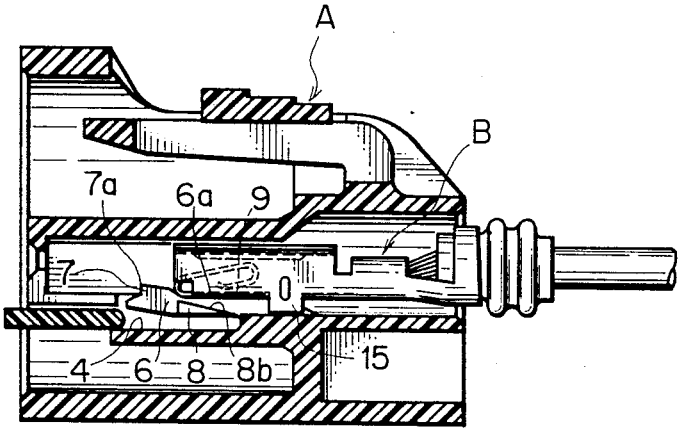
Figure 3C:
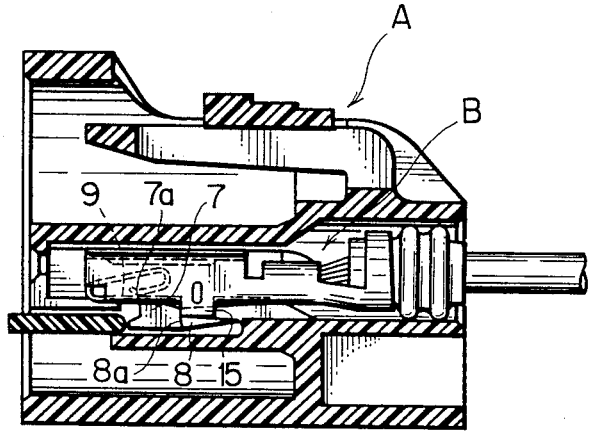

Then as shown in FIG. 3C, when the terminal B further advances and the base plate 9 contacts the top surface 7*a* of the first engagement projection 7, the apexes 8*c* of the second engagement projections 8 come close to the lower ends of the engagement pieces 15.

In the process intermediate between FIGS. 3B and 3C, the lower ends of the engagement pieces 15 pass over the tapered slopes 8*b* at the rear of the second engagement projections 8. The contact between the base plate 9 and the first projection 7 and between the engagement pieces 15 of the terminal B and the second engagement projections 8 is both made through line or point contact. Thus the contact resistance is small.

Figure 3D:
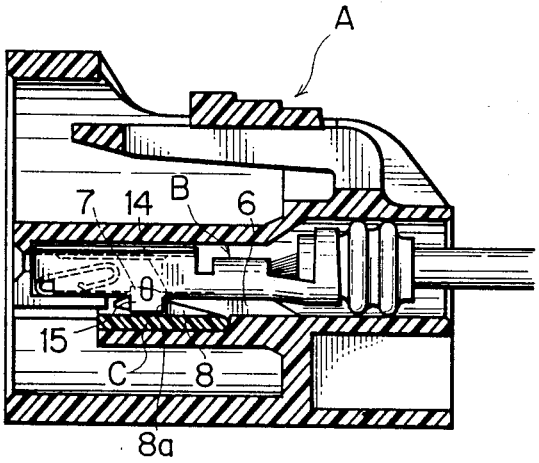

When the engagement hole 14 reaches the first engagement projection 7, the flexible engagement arm 6 snaps back to its original shape by elasticity. As a result, as shown in FIGS. 3D and 4, the first engagement projection 7 engages with the engagement hole 14 of the terminal B and almost at the same time the vertical shoulder surfaces 8*a* of the second engagement projections 8 engage with the rear edges of the engagement pieces 15, providing a double locking of the terminal B. In this double-locking condition, the lock member C is further inserted with force between the flexible engagement arm 6 and the inner wall 4 to securely lock the terminal B. This prevents the flexible engagement arm 6 from being deflected toward the inner wall 4.

Not only is the terminal B doubly locked by the flexible engagement arm 6 and by the engagement between the engagement pieces 15 and the second engagement projections 8, but the flexible engagement arm 6 is also locked from deflection by the insertion of the lock member C. This combination of locking mechanisms increases the fixing force of the connector.

When the terminal B is inserted imperfectly, the engagement between the engagement pieces 15 of the terminal B and the tapered slopes 8*b* of the second engagement projections 8 will deflect the flexible engagement arm 6 toward the inner wall 4 to such an extent that the lock member C cannot be inserted. This prevents any incomplete terminal connection.

Furthermore, with the terminal B completely inserted, the engagement pieces 15 hold the flexible engagement arm 6 from both sides, thus eliminating the lateral play of the terminal B to help maintain its stable attitude.

While in the above embodiment the terminal B is shown to be a female terminal with a tab receiving portion 11, the invention can also be applied to male terminals. It is also possible to employ a construction in which the flexible engagement arm 6 is provided to the other inner wall 5 so that the first engagement projection 7 of the arm will engage with the shoulder 11*a* of the tab receiving portion 11. In stead of forming the rear part of the second engagement projections 8 into the tapered slopes 8*b*, the front part of the engagement projections 15 of the terminal B may be tapered. Or both of them may be tapered.

As described above, with this invention, it is possible to avoid an increase in the size of the terminal accommodating chamber and in the complexity of the internal structure, to allow the terminal to be inserted with a force comparable to that with the conventional connectors, and to prevent the terminal from slipping off from the rear part of the connector by double (or triple) locking, thereby reinforcing the terminal fixing force and substantially improving the reliability of electrical connection.

What is claimed is:

1. A double locking structure for terminal in electrical connectors, comprising:

a connector housing having a terminal accommodating chamber therein;

a flexible engagement arm provided at an inner wall of the terminal accommodating chamber of the connector housing, said flexible arm extending forwardly;

a first engagement projection formed at a free end of the flexible engagement arm, the first engagement projection being adapted to engage with an engagement hole or recess formed in the terminal inserted in the terminal accommodating chamber;

a second engagement projection formed at least at one side of the flexible engagement arm; and an engagement piece formed in the terminal, the engagement piece being adapted to engage with the second engagement projection;

whereby the first and second engagement projections cooperate to doubly prevent the terminal from slipping off from the rear of the connector.

2. A double locking structure for terminal in electrical connectors, as set forth in claim 1, wherein the second engagement projection has its front part formed into a vertical shoulder surface and the rear part into a tapered slope.

3. A double locking structure for terminal in electrical connectors, as set forth in claim 1, wherein when the flexible engagement arm and the terminal are engaged, a lock member is inserted between the flexible engagement arm and the inner wall of the terminal accommodating chamber to prevent deflection of the flexible engagement arm.

4. A double locking structure for terminal in electrical connectors, as set forth in claim 1, wherein the second engagement projection is provided between a fulcrum of the flexible engagement arm and the first engagement projection.

5. A double locking structure for terminal in electrical connectors, as set forth in claim 1 or 4, wherein the apex of the second engagement projection is set lower than the upper surface of the flexible engagement arm.

* * * * *